US010337286B1

(12) United States Patent
Bair et al.

(10) Patent No.: US 10,337,286 B1
(45) Date of Patent: Jul. 2, 2019

(54) RESEALABLE TUBING DRAIN FOR OILFIELD SERVICE

(71) Applicant: Black Gold Pump and Supply, Inc., Signal Hill, CA (US)

(72) Inventors: Michael Bair, Los Angeles, CA (US); Scott Sakakura, Los Angeles, CA (US); Simon Shin, Los Angeles, CA (US)

(73) Assignee: Black Gold Pump and Supply, Inc., Bakersfield, CA (US)

( * ) Notice: Subject to any disclaimer, the term of this patent is extended or adjusted under 35 U.S.C. 154(b) by 92 days.

(21) Appl. No.: 15/723,018

(22) Filed: Oct. 2, 2017

Related U.S. Application Data

(60) Provisional application No. 62/403,845, filed on Oct. 4, 2016.

(51) Int. Cl.
*E21B 34/12* (2006.01)
*E21B 34/00* (2006.01)

(52) U.S. Cl.
CPC ..... *E21B 34/12* (2013.01); *E21B 2034/002* (2013.01)

(58) Field of Classification Search
CPC ..... E21B 43/12; E21B 43/121; E21B 43/126; E21B 43/127; E21B 34/12; E21B 2034/002
USPC ..... 251/297, 343–345
See application file for complete search history.

(56) References Cited

U.S. PATENT DOCUMENTS 8,607,874 B2 * 12/2013 Schultz ..... E21B 43/2406 166/330

* cited by examiner

*Primary Examiner* — Blake E Michener
(74) *Attorney, Agent, or Firm* — James M. Duncan, Esq.; Klein DeNatale Goldner

(57) ABSTRACT

A tubing drain for service with oil wells, water wells, gas wells and/or thermal wells has a configuration of structural features which allow the drain to be opened and closed without the need to pull the drain to the surface to be serviced. The drain utilizes an inner mandrel having two circumferentially aligned cylindrical apertures which may be selectively aligned with a drain port in an outer shell member as the inner mandrel is rotated within the shell. A first cylindrical aperture contains a ball which, when in alignment with the drain port, is urged against a seat in the drain port by hydraulic pressure. However, when the inner mandrel is rotated the ball is dislodged from the seat and forced back into the first cylindrical aperture. Further rotation of the inner mandrel aligns the second cylindrical aperture with the drain port, allowing the tubing to drain.

12 Claims, 3 Drawing Sheets

RESEALABLE TUBING DRAIN FOR OILFIELD SERVICE

RELATED APPLICATIONS

U.S. Application No. 62/403,845 for this invention was filed on Oct. 4, 2016, for which application these inventors claim domestic priority, and which application is incorporated in its entirety.

BACKGROUND OF THE INVENTION

This invention relates to devices for draining fluids from a tubing string in a hydrocarbon production well. Tubing drains allow fluids to drain from the tubing string of a well. Among other purposes, draining fluid from the tubing string allows the tubing to be removed from a well without pulling the tubing "wet", which occurs when there is an obstruction in the tubing which prevents the fluid from draining out of the bottom of the tubing. For example, if the well is produced with a rod pump and the rods have parted leaving a pump or plunger at the bottom of the tubing string, the tubing will stand full of fluid requiring the well to be pulled wet, unless a drain can be actuated which allows the fluid to escape from the inside of the tubing into the casing-tubing annulus. Pulling the tubing wet can result in produced fluid being spilled on the ground surface as well as potentially spraying the production rig crew as the tubing joints are unscrewed. Such releases may violate a variety of laws and regulations, including those pertaining to environmental protection and occupational health and safety.

Tubing drains are typically operated either by manipulation of the tubing, usually by rotation, or by applying pressure to the tubing string to a sufficiently high pressure to burst one or more rupture disks or pins contained within the tubing drain. In either case, once the drain is opened, the tubing must be pulled to the surface so that the drain may be refurbished with the replacement of the rupture disks or pins.

The drains which are activated by rotating the tubing typically utilize a plug located in the body of the drain which is dislodged when the tubing is rotated. The dislodged plug allows the tubing to drain through the resulting open port. The plug is typically propelled out of the drain body falling downhole, which means that once the drain is activated it cannot be closed. In other words, once the plug is out, the tubing drain and tubing must be pulled out of the hole and the drain serviced to replace the plug.

Drains which are actuated by application of tubing pressure are the most commonly used. These drains utilize hydraulically actuated rupture disks or pins and require the application of pressure to the tubing at the surface. Once the pressure at the tubing drain reaches a certain pressure, the disk or pins rupture. As the fluid drains from the tubing, the respective fluid levels in the tubing and in the casing-tubing annulus equalize. Like the tubing drain described above, which is actuated by tubing manipulation, the drains which utilize rupture disks and pins can only be used one time and thereafter the drain must be pulled out of the well to be serviced with the installation of new rupture disks or pins.

The hydraulically actuated drains have a further disadvantage in that the drains can be inadvertently actuated. In such cases, the production equipment—usually comprising a rod string, downhole pump, and tubing string—becomes inoperable and must be removed to change out the hydraulic drain. Unintentional rupturing of the disk or shear pins can be caused, of course, by the pressuring up of the tubing by some event, such as the accidental closing of a valve on a surface production line. However, other phenomena may also rupture the disk or shear pins. For example, the movement of rod couplings within the tubing string presents a potential mechanism for rupturing the disk. Physical contact between a rod coupling and the disk can cause rupturing of the disk by the impact by the coupling upon the disk. In addition, the motion of the coupling in close proximity to the hydraulic drain can cause a localized pressure spike resulting from the piston effect of the coupling inside or adjacent to the drain. The likelihood of such premature rupturing of the disk increases with the decrease in clearance between the rod coupling and the inside diameter of the hydraulic drain.

Another disadvantage of some hydraulic drains is that the rupture disks or pins are often uncontained when ruptured such that the disk or pin remnants end up inside the well, leaving junk/trash which can either interfere with the operation of downhole equipment or which can accumulate with other debris to create a wellbore obstruction.

Another disadvantage of both the hydraulic and mechanical drains described above is that there are occasions when a well problem might otherwise be resolved without pulling the tubing. However, once the tubing drain is activated, it becomes necessary to pull the tubing and the tubing drain to refurbish the drain. In all such occurrences, pulling the tubing string is expensive because of the required crew and equipment and also because of the resulting loss of hydrocarbon production lost while the well is inactive.

As illustrated by the disadvantages described above, there are benefits to be gained if pulling the tubing string for servicing of the drain can be avoided by a tubing drain which is capable of being resealed in situ following activation of the drain.

SUMMARY OF THE INVENTION

Embodiments of the apparatus disclosed herein provide a solution to the problems described above. For purposes of this disclosure, the terms "lower," "bottom," "downward," etc., refer to a direction facing toward the bottom of a well and the terms "upper," "top," "up," etc., refer to a direction facing toward the ground surface. The terms "inward" and "inwardly" refer to a direction facing toward the central axis of the disclosed hydraulic drain and the terms "outward" and "outwardly" refer to a direction facing outward towards the inside wall of the casing string. The term "radially" refers to a direction either facing toward the central axis of the disclosed hydraulic drain or toward the inside wall of the casing string.

Embodiments of the disclosed tubing drain have a port which opens upon rotation of the tubing. However, in contrast to other tubing drains, if desired, the port may also be closed by rotation of the tubing in the opposite direction. Thus, various procedures—including tubing tests, upper well circulation, killing the well, and chemical treatments—may be conducted through the use of embodiments of the disclosed drain without the necessity of pulling the tubing string to redress the tubing drain, allowing the well to be returned to production. Unlike other tubing drains, embodiments of the present invention are not subject to accidental actuation such as may occur during installation or during production operations from the reciprocation of rod strings within the drain. Moreover, when embodiments of the disclosed drain are pulled to the surface, the devices typically only require inspection rather than full servicing as compared to the known drains which require replacement of rupture disks, shear pins, or drain plugs.

An embodiment of the disclosed drain comprises a ball and seat valve configuration. In the closed position, the ball is urged against the seat by the hydraulic pressure of the fluid column in the tubing. When it is desired to open the drain, the ball is dislodged from the seat by the rotation of the tubing, and the tubing is rotated until an open aperture in an inner mandrel is aligned with an open aperture which extends radially outward from the seat thereby proving a conduit for flow of fluid in the tubing above the drain to exit into the casing-tubing annulus.

Embodiments of the invention may further comprise an inner mandrel, an outer shell, and nut which secures the inner mandrel within the outer shell, but leaves the inner mandrel rotatable within the outer shell. The exterior surface of the inner mandrel has a groove which extends partially around the circumference of the inner mandrel. A pin extending radially inward from the outer shell is inserted within the groove, such that as the inner mandrel is rotated within the outer shell, the pin is guided by the groove, with the groove having a termination at each end which stops the travel of the pin and thus limits the rotation of the inner mandrel with respect to the outer shell.

The inner mandrel may have two circumferentially aligned cylindrical apertures which penetrate through the wall of the mandrel. One of the cylindrical apertures contains a ball. The outer shell has a drain port which extends through the wall of the outer shell, where the drain port comprises a ball seat lodged therein. The ball is seated on the ball seat while the tubing string and drain are run into the well. After the tubing is set, and the well is put on production, the hydrostatic pressure of the fluid column inside the tubing applies a force which urges the ball against the ball seat, creating an efficient fluid seal. To actuate the drain, the tubing is rotated such that the relative motion of the inner mandrel with respect to the outer shell knocks the ball off the seat by the application of a force tangential to the ball. The ball remains in the cylindrical aperture of the inner mandrel. To reseal the drain, the tubing is rotated back to the original position thereby returning the ball to a position adjacent to the ball seat, allowing hydrostatic pressure of the fluid column in the tubing to urge the ball against the seat thereby closing the drain.

DETAILED DESCRIPTION OF THE EMBODIMENTS

Figure 1:
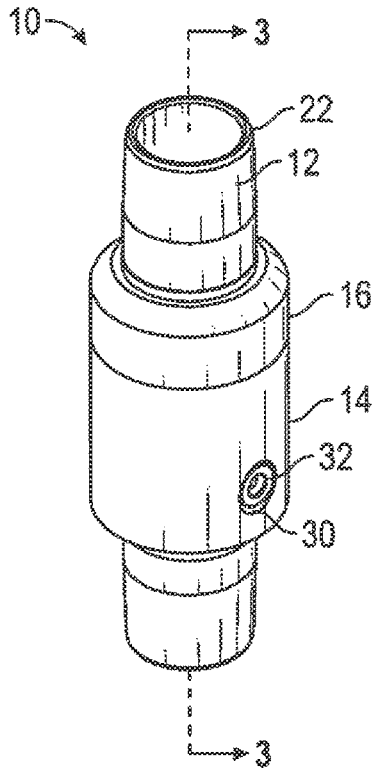
FIG. 1 shows a perspective side view of an embodiment of the present invention.
Figure 2:
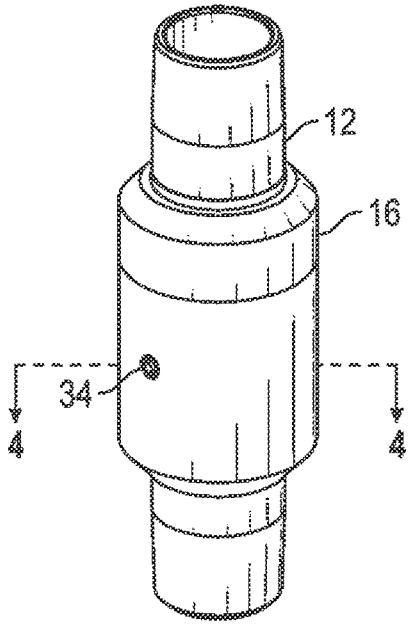
FIG. 2 shows a second perspective side view of an embodiment of the present invention.
Figure 3:
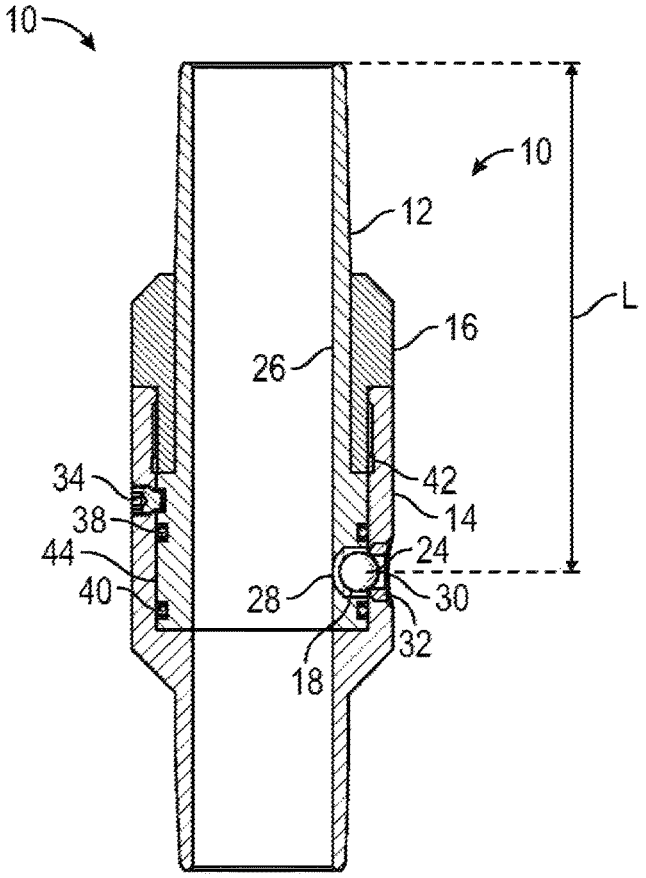
FIG. 3 shows a sectioned view taken approximately along line 3-3 of FIG. 1.

Referring specifically to the figures, FIG. 1 shows an embodiment of the disclosed resealable tubing drain 10. This embodiment has an inner mandrel 12 and a shell member 14 into which a portion of the inner mandrel is inserted, leaving an upper portion of the inner mandrel 12 exposed as shown in the Figures. A nut member 16 retains the inner mandrel 12 to the shell member 14.

The inner mandrel 12 has two cylindrical apertures 18 and 20 which may be in circumferential alignment about the inner mandrel. For purposes of this disclosure, the phrase "circumferential alignment" refers to a configuration where the center axis of aperture 18 and the center axis of aperture 20 are each the same distance from the upper end 22 of the inner mandrel 12 and are thus in a same plane which perpendicularly bisects the inner mandrel 12. A ball 24 is set within cylindrical aperture 18. The inner wall 26 of inner mandrel 12 has an opening 28 which has a diameter smaller than the diameter of ball 24, such that ball 24 is subject to the pressure on the inside of inner mandrel 12, but cannot enter into the inside of inner mandrel 12.

Shell member 14 has a drain port 30 extending through the wall of the shell member. A ball seat 32 is set within drain port 30. Inner mandrel 12 is rotatable within shell member 14 from a first position in which aperture 18 is aligned with the drain port 30 to a second position in which aperture 20 is aligned with the drain port 30. When aperture 18 is aligned with drain port 30, ball 24 is urged against ball seat 32 when there is pressure on the inside of inner mandrel 12, such as the hydrostatic pressure applied by a fluid column inside the tubing. When ball 24 is urged against ball seat 32, it provides a seal which prevents fluid in the tubing from draining out into the casing-tubing annulus. However, when aperture 20 is aligned with the drain port 30, any fluid in the tubing which is above aperture 20 will drain through drain port 30. Thus, when installed in a tubing string of an oil well, rotation of the tubing will rotate the inner mandrel 12 from the first position to the second position, and fluid will drain from the tubing string until the fluid in the tubing either drains to the level of the drain port 30 or equalizes with the fluid level in the casing.

There is an O-ring 38 installed in an upper O-ring groove of the inner mandrel 12. O-ring 38 creates a seal between the inner mandrel 12 and inside surface of the shell 14 which prevents fluid inside the tubing string from leaking around the inner mandrel 12 and between the outer surface of the inner mandrel 12 and nut member 16. Likewise, there is an O-ring 40 installed in a lower O-ring groove of the inner mandrel 12. When the second aperture 20 aligns with the drain port 30, O-rings 38 and 40 allow fluid to only drain through second aperture 20. O-ring 42 is installed between a shoulder of the inner mandrel 12 and the end of the pin thread of nut member 16. O-ring 42 also allows the inner mandrel 12 to rotate more easily within shell member 14.

Figure 4:
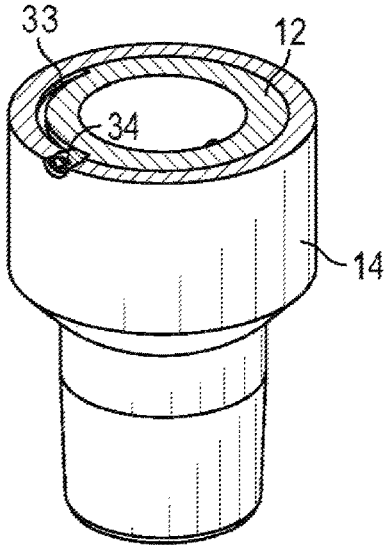
FIG. 4 shows a sectioned view taken approximately along line 4-4 of FIG. 2.
Figure 5:
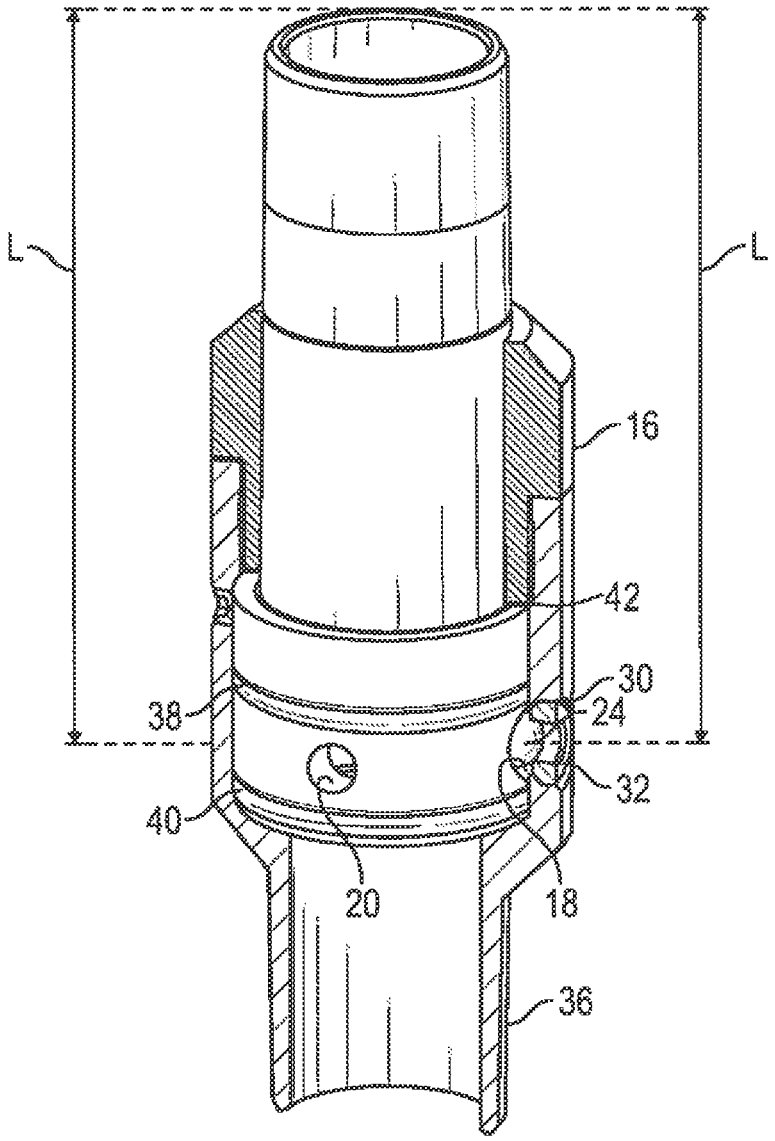
FIG. 5 shows a partial sectional perspective view of an embodiment of the present invention.

FIG. 4 shows the mechanism which controls the rotation of inner mandrel 12 within shell member 14. The exterior surface 44 of inner mandrel 12 has a groove 33, which extends partially around the circumference of the exterior surface. A pin 34 within shell member 14 extends radially inward from the shell member and engages the groove, such that as the inner mandrel 12 is rotated within the shell member, the pin 34 is guided by the groove, with each end of the groove stopping the travel of the pin. The lower end 36 of shell member 14 attaches to the tubing string, which in turn will typically have a tubing anchor which prevents or limits rotation of the shell member 14, thereby allowing the rotation of the inner mandrel 12 within the shell member. Groove 33 extends sufficiently around the circumference of the inner mandrel 12 to allow for any rotation of the shell member 14 until the resistance of the tubing anchor is realized at the drain. The inventors herein have found that a groove which extends approximately 310 degrees about the circumference of the inner mandrel 12 is sufficient.

Ball 24 is placed adjacent to seat 32 while the drain 10 is run down hole on the tubing string, allowing flow by the ball 24 from the casing-tubing annulus into the interior of the tubing. After the tubing and rods are installed and the well put on production, the pressure inside the tubing applied by the fluid column applies a hydraulic force to the ball 24 which urges the ball against seat 32 to create an efficient fluid seal to prevent fluid flow from the inside of the tubing to the casing-tubing annulus. To actuate the drain 10, the tubing is typically rotated clockwise which causes inner mandrel 12 to rotate within shell member 14 with pin 34 traveling along the length of groove 33, which may result in a turn of approximately 310 degrees clockwise. While the drain could also be manufactured to operate by counter-clockwise rotation, such rotation potentially loosens normal (as opposed to reverse) tubing threads. The rotation of the inner mandrel 12 dislodges ball 24 from seat 32 by application of a force which is tangential to the ball 24 and seat 32, pushing ball 24 radially inward into aperture 18, where the ball is stopped by the smaller diameter of opening 28 from entering the interior of the inner mandrel 12. In order to reseal the drain 10 the tubing is rotated back the same amount of rotation, which positions the ball 24 adjacent to the seat 32 again. The well may be put back on production to then increase the pressure inside the tubing, allowing the ball to again create an efficient seal onto the seat.

While the above is a description of various embodiments of the present invention, further modifications may be employed without departing from the spirit and scope of the present invention. Thus the scope of the invention should not be limited according to these factors, but according to the following appended claims.

What is claimed is:

1. A drain for draining a tubing string in a well, the drain comprising:

an inner mandrel having a first cylindrical aperture and a second cylindrical aperture, the first cylindrical aperture and the second cylindrical aperture in circumferential alignment about the inner mandrel;

a ball disposed within the first cylindrical aperture;

a shell member having a wall which defines an axially aligned opening into which a portion of the inner mandrel is disposed, the shell member having a drain port extending through the wall, wherein the drain port comprises a ball seat;

wherein the inner mandrel is rotatable within the shell member from a first position in which the first cylindrical aperture is aligned with the drain port and the ball is urged against the ball seat to a second position in which the ball is dislodged from the ball seat and the second cylindrical aperture is aligned with the drain port.

2. The drain of claim 1 wherein the inner mandrel comprises an exterior surface having a circumference, the exterior surface comprising a groove which extends partially around the circumference.

3. The drain of claim 2 wherein the shell member comprises an inwardly facing pin which engages the groove as the inner mandrel is rotated within the shell member.

4. The drain of claim 3 wherein the groove extends a range of 270 to 320 degrees about the circumference of the inner mandrel.

5. The drain of claim 1 wherein an upper O-ring is disposed on an upward side of the drain port and a lower O-ring is disposed on a downward side of the drain port.

6. The drain of claim 1 further comprising a nut member which slides over the inner mandrel and makes up to the shell member.

7. A drain for draining a tubing string in a well, the drain comprising:

an inner mandrel having an upper end, a lower end and a mandrel wall, with an axially-aligned opening defined within the mandrel wall, the mandrel wall having an inside and an outside, the axially-aligned opening extending between the upper end and the lower end, wherein a central axis is defined between the upper end and the lower end;

a first cylindrical aperture extending radially outward from a first opening having a first diameter on the inside of the mandrel wall to a second opening having a second diameter on the outside of the mandrel wall, the first cylindrical aperture spaced at a distance L from the upper end;

a ball disposed within the first cylindrical aperture, the ball having a diameter;

a second cylindrical aperture extending radially through the mandrel wall, the second cylindrical aperture spaced at a distance L from the upper end;

a circumferential groove extending partially around the outside of the mandrel wall;

a shell member having an axially aligned opening into which a portion of the inner mandrel is disposed, the shell member having an inside surface and an outside surface;

a drain port extending through the inside surface to the outside surface;

a ball seat disposed within the drain port;

wherein the inner mandrel is rotatable from a first position in which the first cylindrical aperture is in alignment with the drain port to a second position in which the second cylindrical aperture is in alignment with the drain port.

8. The drain of claim 7 wherein the first diameter is smaller than the diameter of the ball.

9. The drain of claim 8 further comprising a pin member extending radially inward from the inside surface of the shell member, an end of the pin member engaging the circumferential groove as the inner mandrel is rotated between the first position and the second position.

10. The drain of claim 7 comprising a nut member which slides over the inner mandrel and makes up to the shell member.

11. The drain of claim 7 wherein the circumferential groove extends a range of 270 to 320 degrees about the circumference of the inner mandrel.

12. The drain of claim 7 wherein an upper O-ring is disposed on an upward side of the drain port and a lower O-ring is disposed on a downward side of the drain port.

* * * * *